United States Patent [19]

Kuehnel

[11] Patent Number: 4,982,418

[45] Date of Patent: Jan. 1, 1991

[54] X-RAY DIAGNOSTICS INSTALLATION HAVING A MEAN IMAGE BRIGHTNESS DETECTOR

[75] Inventor: Werner Kuehnel, Uttenreuth, Fed. Rep. of Germany

[73] Assignee: Siemens Aktiengesellschaft, Berlin and Munich, Fed. Rep. of Germany

[21] Appl. No.: 410,346

[22] Filed: Sep. 21, 1989

[30] Foreign Application Priority Data

Oct. 5, 1988 [EP] European Pat. Off. ..... 8816488.3

[51] Int. Cl.[5] ..... H05G 1/10

[52] U.S. Cl. ..... 378/95; 378/99; 358/111

[58] Field of Search ..... 378/95, 98, 99, 57, 378/62; 358/111

[56] References Cited

U.S. PATENT DOCUMENTS 4,076,985 2/1978 LeMay .
4,185,198 1/1980 Fujimoto .
4,335,311 6/1982 Lutz et al. .
4,517,594 5/1985 Horbaschek .
4,674,108 6/1987 Asahina et al. .

FOREIGN PATENT DOCUMENTS 0063644 11/1982 European Pat. Off. .
0217456 4/1987 European Pat. Off. .
2740998 3/1979 Fed. Rep. of Germany ..... 378/95
0075800 5/1983 Japan ..... 378/95

*Primary Examiner*—Janice A. Howell
*Assistant Examiner*—David P. Porta
*Attorney, Agent, or Firm*—Hill, Van Santen, Steadman & Simpson

[57] ABSTRACT

An x-ray diagnostics installation has a detector for the mean image brightness in a predetermined region which is within the x-ray beam path. The detector is formed by a matrix of individually activateable detector elements. A control unit, connected to the detector, has a memory in which data sets are stored respectively corresponding to different anatomical parts and positions of those parts. A selection unit identifies and selects a data set corresponding to the anatomical part currently being examined, and the detector elements in the array corresponding to that part are then activated via the control unit. The radiation incident on the acitvated detector elements is then compared, in the aggregate, to a rated value, and the radiation dose is controlled on the basis on the comparison.

3 Claims, 1 Drawing Sheet

X-RAY DIAGNOSTICS INSTALLATION HAVING A MEAN IMAGE BRIGHTNESS DETECTOR

BACKGROUND OF THE INVENTION

1. Field of the Invention

The present invention is directed to an x-ray diagnostics installation having a mean image brightness detector, and in particular to such an installation wherein the detector is formed by a matrix of detector elements, and having a control unit to select predetermined elements for signal generation.

2. Description of the Prior Art

X-ray diagnostics systems are known which include a mean image brightness detector. It is also known to form the detector of a matrix of detector elements. Detectors of this type are used in an automatic exposure control loop for recording an image or for transillumination. The mean image brightness in a region corresponding to the organ or body part of which an image is to be generated must be measured and maintained constant. It is known for this purpose to provide a fixed number of measuring fields within the detector by using a matrix of semiconductor detector elements. Arbitrary measuring field shapes can then be achieved by selectively activating individual detector elements. This also permits a rapid change in the measuring field shape to be made. It is also possible to differently weight the output signals of the selected detector elements.

For the best exposure, the selected measuring field must be adapted as closely as possible to the body part of which an image is be obtained.

SUMMARY OF THE INVENTION

It is an object of the present invention to provide an x-ray diagnostics installation having a mean image brightness detector which is capable of automatically assuming a number of different measuring fields having variable shape.

It is a further object of the present invention to provide such an x-ray diagnostics installation wherein the selected measuring field is optimally adapted to the particular image to be generated.

The above object is achieved in accordance with the principles of the present invention in an x-ray diagnostics installation having a memory in which a plurality of data sets, respectively corresponding to various organs and anatomical regions, and a selection unit for selecting the data set corresponding to the organ or body region to be imaged, and also corresponding to a stored absorption profile. A typical two-dimensional rough absorption profile of the transillumination image is stored in the selection stage for each organ or body region to be examined. For the purpose of a pattern recognition, this profile is compared to the current signals from the detector elements, with the precise natural and position of the organ or body region to be examined being capable of being identified based on this comparison. The detector elements needed for the proper exposure of the organ or body region are then automatically selected by the selection stage.

DESCRIPTION OF THE PREFERRED EMBODIMENTS

Figure 1:
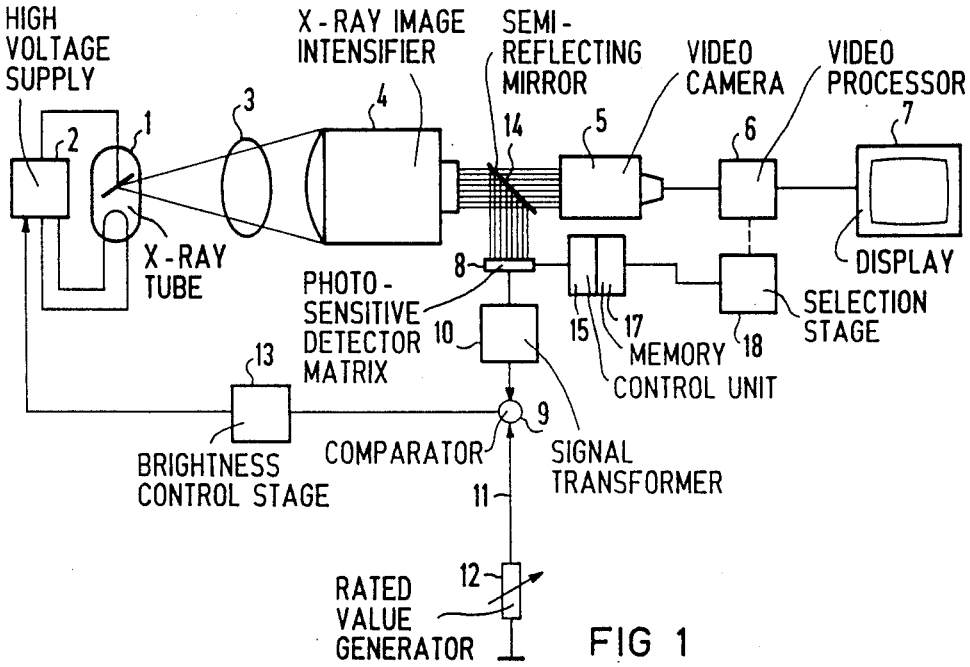
FIG. 1 is a schematic block diagram of an x-ray diagnostics installation constructed in accordance with the principles of the present invention.

An x-ray diagnostics installation constructed in accordance with the principles of the present invention is shown in FIG. 1. The installation includes an x-ray tube 1 which is fed by a high voltage supply 2. A patient 3 is trans-irradiated by x-radiation generated by the x-ray tube Radiation attenuated by the patient is incident on the input screen of an x-ray image intensifier 4. An intensified x-ray image appears at the output screen of the x-ray image intensifier 4, and is picked-up by a video camera 5 and is reproduced on a display 7 via a video signal processor 6.

To maintain the mean image brightness in a measuring field of the output screen of the x-ray image intensifier 4 at a constant value, a semiconductor photosensitive detector matrix or array 8 is provided as an actual value generator. Light from the output screen of the x-ray image intensifier is reflected onto the detector matrix 8 by a semi-reflecting mirror 14, with the remainder of the light being picked-up by the video camera 5. As described in greater detail below, the detector matrix 8 consists of a plurality of discrete semiconductor detectors. The electrical output signals of the individual detectors are supplied to a signal transformer 10. The input signals to the transformer 10 are then combined as needed, such as to form a mean value of the individual detector signals, and the transformed signal, such as the mean value, is supplied to an actual value input of a comparator 9. A rated value signal is generated by a rated value generator 12, and is supplied at a rated value input 11 to the comparator 9. The comparator compares the actual value from the transformer 10 with the rated value at the input 11, and supplies a signal to a brightness control stage 13, which controls the output of the high voltage supply 2 based on the difference between the actual value and the rated value.

The semiconductor photo-sensitive detector matrix 8 has a surface on which the entire output image of the x-ray image intensifier is incident. Each semiconductor detector comprising the matrix 8 is individually activateable by a control unit 15. The control unit 15 can thus electronically activate a predetermined region of the matrix 8 according to the desired measuring field. This permits the selection of the position, shape and size of a plurality of different measuring fields.

The control unit 15 is connected to, or includes, a memory 17 in which a plurality of data sets corresponding to different organs or anatomical regions to be examined are stored. A selection stage 18 permits an organ or body region, and an absorption profile, to be selected, on the basis of which the memory 17 provides the data set corresponding to the selected organ or anatomical region to the control unit 15.

Figure 2:
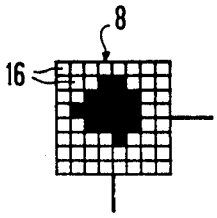
FIG. 2 is a front view of the detector matrix in the x-ray diagnostics installation of FIG. 1.

A plurality of absorption profiles of various body parts is stored two-dimensionally in the selection stage 18. The totality of the output signals of the detector elements 16 (as shown in FIG. 2) of the semiconductor detector matrix 8 is compared to the stored absorption profiles in the selection stage 18 for the purpose of a pattern recognition. Based on this comparison, the precise nature and position of the organ or body region to be examined can be defined in the image. The control unit 15 thereupon activates the detector elements 16 required for correct illumination of the body part.

As shown in FIG. 2, activated detector elements 16 are blackened. FIG. 2 shows that, given an appropriatedly fine subdivision of the detector 8, an exact matching of the body part to be examined to the predetermined region within which the mean image brightness is to be maintained constant during transillumination is possible.

The information corresponding to the respective body region and the activated detector elements 16 can, as described above, be acquired from the totality of the output signals of the detector elements 16. It is also possible, however, to use the video signal from the video processor 6 for this purpose, as indicated by the dashed line in FIG. 1.

The automatic formation of the optimum region within which the acquisition of the output signals of the detector element ensues for control of the transillumination can also be used for indirect recordings. In a recording mode, either the preceding transillumination image can be evaluated for the purpose of selecting the measuring field, or the registered image itself can be evaluated if the pattern recognition is quick enough.

The automatic selection of the measuring field can be expanded to the direct registration technique if the detector matrix is subdivided finely enough.

It is also possible within the principles of the present invention to provide additional information to the attending physician or radiologist when an exact positioning of the organ or body region under examination occurs, for example, by the generation of an appropriate signal given automatic positioning of a heart contour diaphragm.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray diagnostics installation comprising:

means for generating an x-ray beam in which an examination subject is disposed;

means for detecting radiation attenuated by said subject and forming a light image from the attenuated radiation;

a matrix of photo-sensitive detector elements on which said light image is incident, said photo-sensitive detector elements being individually activateable;

control means connected to said detector elements in said matrix for individually activating selected detector elements;

a memory connected to said control means in which a plurality of data sets are stored corresponding to respective organs and body regions; and selection means connected to said memory and having a plurality of radiation absorption profiles stored therein for selecting a data set and a stored absorption profile corresponding to an organ or body region to be examined.

2. An x-ray diagnostics installation as claimed in claim 1, wherein said selection means is supplied with a signal which is the totality of the output signals of said detector elements in said matrix, and wherein said selection means selects a data set based on said totality of output signals.

3. An x-ray diagnostics installation as claimed in claim 1, further comprising video means for generating a video signal corresponding to said light image, and wherein said selection means is connected to said video means for receiving said video signal and wherein said selection means selects a data set based on said video signal.

* * * * *